US006550436B2

(12) United States Patent
Nohara et al.

(10) Patent No.: US 6,550,436 B2
(45) Date of Patent: Apr. 22, 2003

(54) INTAKE VALVE CONTROL DEVICE OF INTERNAL COMBUSTION ENGINE

(75) Inventors: Tsuneyasu Nohara, Kanagawa (JP); Shinichi Takemura, Yokohama (JP); Shunichi Aoyama, Kanagawa (JP)

(73) Assignee: Nissan Motor Co., Ltd., Yokohama (JP)

( * ) Notice: Subject to any disclaimer, the term of this patent is extended or adjusted under 35 U.S.C. 154(b) by 40 days.

(21) Appl. No.: 09/934,526

(22) Filed: Aug. 23, 2001

(65) Prior Publication Data

US 2002/0023603 A1 Feb. 28, 2002

(30) Foreign Application Priority Data

Aug. 31, 2000 (JP) ..... 2000-262110

(51) Int. Cl.[7] ..... F01L 1/34

(52) U.S. Cl. ..... 123/90.16; 123/90.17; 123/90.15

(58) Field of Search ..... 123/90.15, 90.16, 123/90.17

(56) References Cited

U.S. PATENT DOCUMENTS 5,542,383 A * 8/1996 Clarke et al. ..... 123/90.17

OTHER PUBLICATIONS

Instructional manual of Toyota Car (Celica) issued on Sep. 1999 from Toyota Jidosha Kabushiki Kaisha; pp. 1–60–1–65; 1–70–I–71; 1–92–1–95.

U.S. patent application Ser. No. 09/803,141, Nohara et al., filed Mar. 12, 2001.

* cited by examiner

*Primary Examiner*—Thomas Denion
*Assistant Examiner*—Jaime Corrigan
(74) *Attorney, Agent, or Firm*—Foley & Lardner

(57) ABSTRACT

An internal combustion engine has an intake valve control device for controlling at least intake valves. The control device comprises a first mechanism which varies a working angle of the intake valve; a second mechanism which varies an operation phase of the intake valve; and a control unit which controls both the first and second mechanisms in accordance with an operation condition of the engine. The control unit is configured to carry out controlling variation in the open timing of the intake valve effected by the first mechanism to be larger than variation in the open timing of the intake valve effected by the second mechanism.

14 Claims, 8 Drawing Sheets

30
1
16
17
18
2
40
13
25
15
12
19
12
19
26
16b
20
16a
32b

IDLE OPERATING RANGE
INT
EXH

ADVANCING VIA PHASE VARIATION
INT
EXH

MIDDLE-LOAD OPERATION RANGE
INT
EXH

INTAKE VALVE CONTROL DEVICE OF INTERNAL COMBUSTION ENGINE

BACKGROUND OF INVENTION

1. Field of Invention

The present invention relates in general to a control device for controlling an internal combustion engine, and more particularly to an intake valve control device of an internal combustion engines, which comprise a working angle varying mechanism for varying the working angle of an intake valve and an operation phase varying mechanism for varying an operation phase of the intake valve.

2. Description of Related Art

Hitherto, various types of intake valve control devices have been proposed and put into practical use in the field of automotive internal combustion engines. One of such types is shown in an instruction manual of Toyota car (Celica) issued on September 1999 from Toyota Jidosha Kabushiki Kaisha, which comprises a working angle varying mechanism which varies the working angle of each intake valve by switching high and low speed cams in accordance with a hydraulic pressure led from an oil pump driven by the engine crankshaft and an operation phase varying mechanism which varies the operation phase of the intake valve by changing a relative angular position between a cam pulley (rotation member) synchronously rotated with the crankshaft and an intake valve cam shaft.

It is now to be noted that the term "working angle" used in the description corresponds to the open period of the corresponding valve or valves and is represented by an angle range (viz., crank angle) of the engine crankshaft, and the term "operation phase" used in the description corresponds to the operation timing of the corresponding valve or valves relative to the engine crankshaft.

SUMMARY OF THE INVENTION

In general, in a middle-load operation range of the engine, improvement in fuel consumption and that in exhaust performance are achieved by providing a satisfied valve overlap between the intake and exhaust valves. With this satisfied valve overlap, the internal EGR is increased and pumping loss is reduced. While, in a very-low-speed (or very-low-load) operation range of the engine, such as, a range provided when the engine is under idling, the valve overlap should be reduced to minimize the residual gas for achieving a stable combustion of the engine. Accordingly, in case of rapid deceleration of engine speed from the middle-load operation range to the very-low-load operation range, it is inevitably necessary to speedily reduce the valve overlap. However, in known intake valve control devices like the above-mentioned one, when, like in the low-speed operation range of the engine, the hydraulic pressure led from the oil pump is low, quick switching of the working angle by the working angle varying mechanism is difficult. Thus, considering the rapid deceleration of the engine speed which takes place upon sharp braking of the associated motor vehicle, the valve overlap can not be so increased.

Accordingly, an object of the present invention to provide an intake valve control device of an internal combustion engine, which can assuredly and speedily reduce the valve overlap even in a rapid deceleration of the engine speed.

Another object of the present invention is to provide an intake valve control device of an internal combustion engine, which can provide in a given operation range a satisfied valve overlap which has a high responsiveness.

According to a first aspect of the present invention, there is provided an intake valve control device of an internal combustion engine having intake and exhaust valves. The control device comprises a first mechanism which varies a working angle of the intake valve; a second mechanism which varies an operation phase of the intake valve; and a control unit which controls both the first and second mechanisms in accordance with an operation condition of the engine, the control unit being configured to carry out controlling variation in the open timing of the intake valve effected by the first mechanism to be larger than variation in the open timing of the intake valve effected by the second mechanism.

According to a second aspect of the present invention, there is provided a method of controlling an internal combustion engine which has intake and exhaust valves, a first mechanism which varies a working angle of the intake valve and a second mechanism which varies an operation phase of the intake valve. The method comprises controlling variation in the open timing of the intake valve effected by the first mechanism to be larger than variation in the open timing of the intake valve effected by the second mechanism.

DETAILED DESCRIPTION OF EMBODIMENT

In the following, an embodiment of the present invention will be described in detail with reference to the accompanying drawings. For ease of understanding, various directional terms such as, right, left, upper, lower, rightward, etc., are used in the description. However, such terms are to be understood with respect to only a drawing or drawings on which the corresponding element or part is illustrated.

As will become apparent as the description proceeds, an intake valve control device of the present invention is explained as to be applied to an internal combustion engine having cylinders each having two intake valves and two exhaust valves, and for ease of explanation, the following description is directed to only a part of the control device, which is associated with one of the cylinders of the engine.

Figure 1:
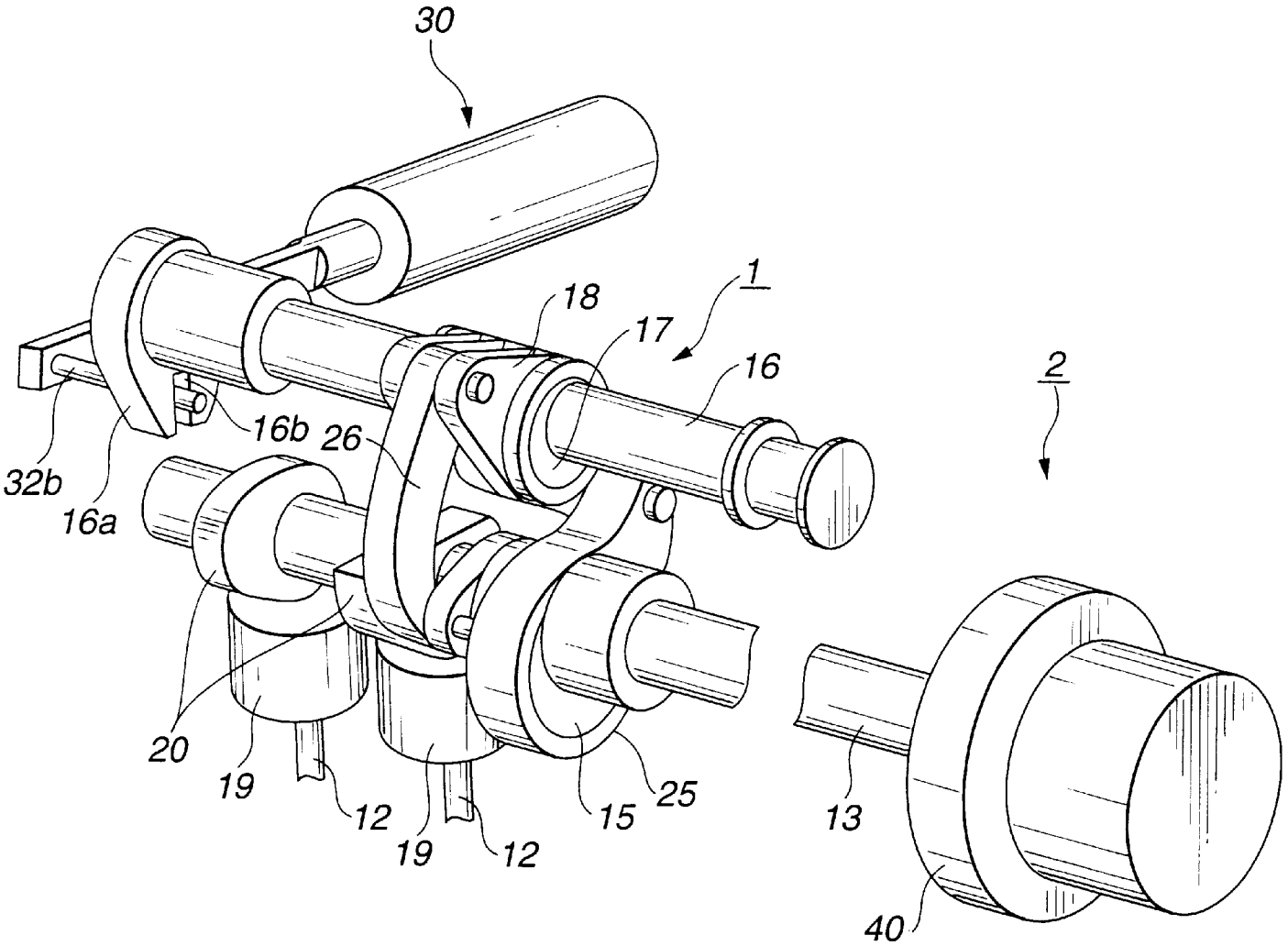
FIG. 1 is a perspective view of an intake valve control device of an internal combustion engine, which is an embodiment of the present invention.
Figure 2:
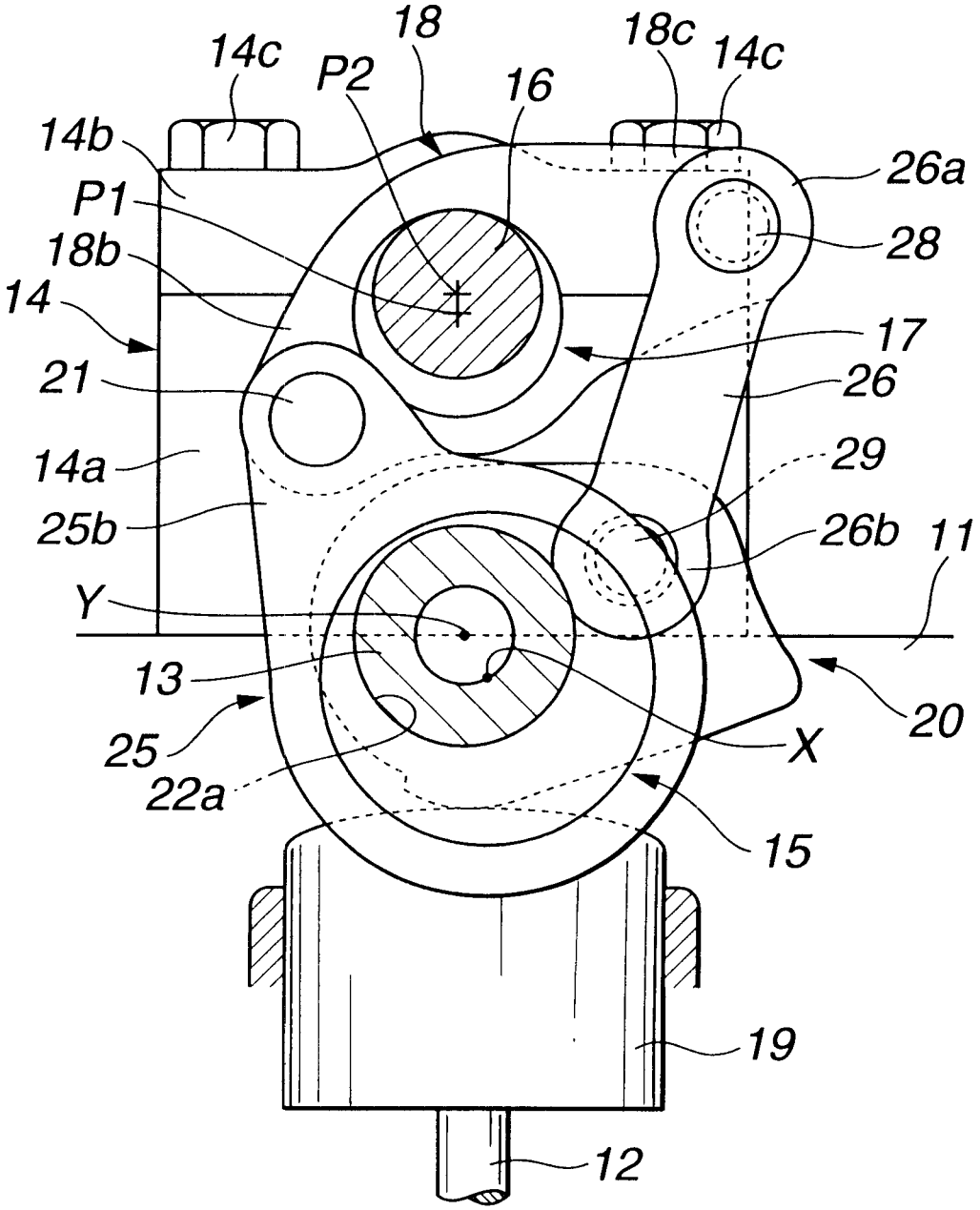
FIG. 2 is a sectional view of the intake valve control device of the invention, showing a part where an working angle varying mechanism is arranged.
Figure 3:
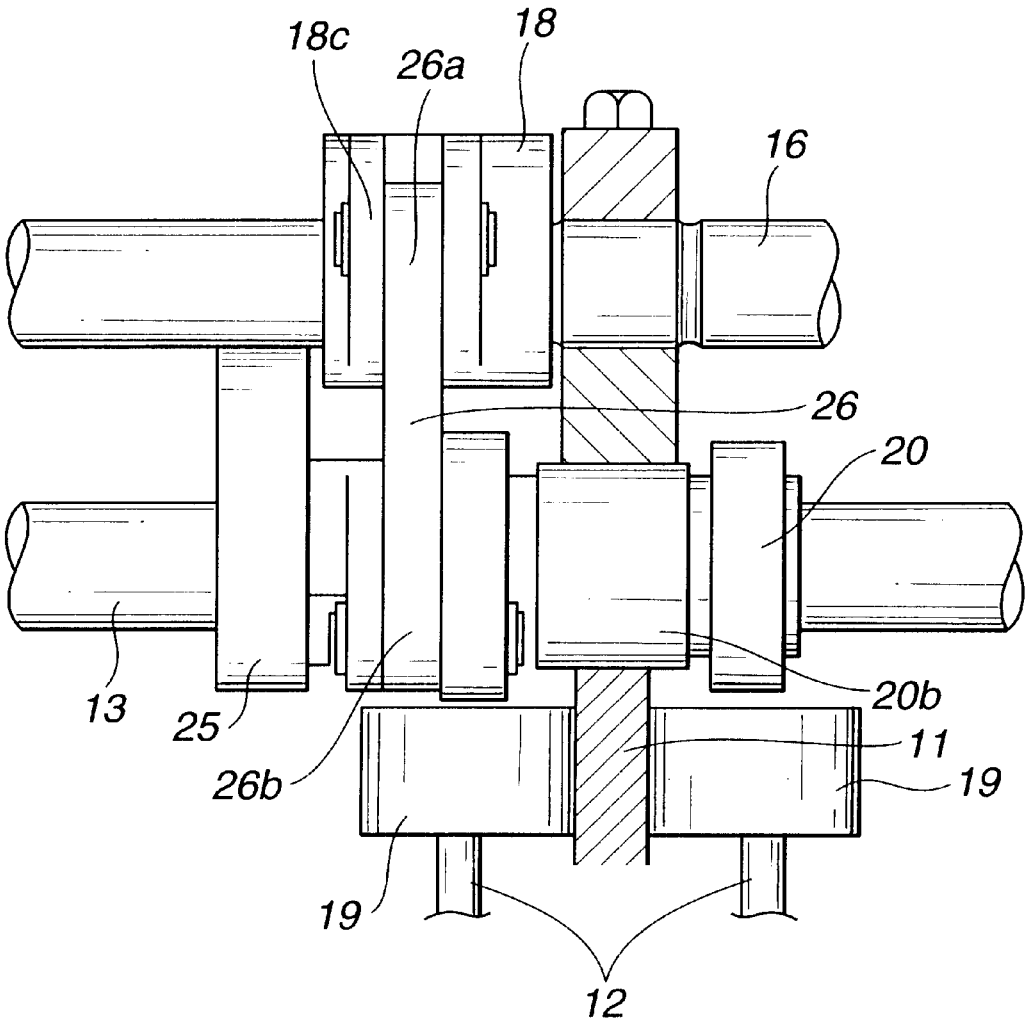
FIG. 3 is a schematic view of the working angle varying mechanism of the intake valve control device of the invention, which is taken from the direction of the arrow "III" of FIG. 1.

Referring to FIGS. 1 to 3, particularly FIG. 1, there is shown an intake valve control device of an internal combustion engine, which is an embodiment of the present invention.

As is seen from FIG. 1, the intake valve control device generally comprises a working angle varying mechanism 1 (or first mechanism) which varies a working angle (and a valve lift degree) of a pair of intake valves 12 of each cylinder, and an operation phase varying mechanism 2 (or second mechanism) which varies the operation phase of the intake valves 12.

As will described in detail in the following, in the working angle varying mechanism 1, there is arranged a link mechanism by which a drive shaft 13 driven by a crankshaft (not shown) of an associated internal combustion engine through the operation phase varying mechanism 2 and two swing cams 20 actuating valve lifters 19 of the intake valves 12 to make open/close movement of the intake valves 12 against valve springs (not shown) are mechanically linked to continuously vary the working angle (and the valve lift degree) of the intake valves 12 while keeping the center point of the working angle constant. It is to be noted that the drive shaft 13 extends in a direction along which the cylinders of the engine are aligned.

That is, the working angle varying mechanism 1 comprises an eccentric cam 15 eccentrically fixed to the drive shaft 13, a ring-like link 25 rotatably disposed on the eccentric cam 15, a control shaft 16 extending in parallel with the drive shaft 13, a control cam 17 eccentrically fixed to the control shaft 16, a rocker arm 18 rotatably disposed on the control cam 17 and having one end 18*b* (see FIG. 2) pivotally connected through a connecting pin 21 to a leading end 25*b* of the ring-like link 25, and a rod-like link 26 by which the other end 18*c* of the rocker arm 18 and one of the swing cams 20 are linked.

As is seen from FIG. 2, the center "X" of the eccentric cam 15 is displaced from the center "Y" of the drive shaft 13 by a predetermined degree, and the center "P1" of the control cam 17 is displaced from the center "P2" of the control shaft 16 by a predetermined degree. As is seen from FIGS. 2 and 3, a journal portion 20*b* of the swing cam 20, which is rotatably disposed about the drive shaft 13, and a journal portion of the control shaft 16 are rotatably held by a pair of brackets 14*a* and 14*b* which are secured to a cylinder head 11 of the engine through common bolts 14*c*.

As is seen from FIG. 1, the rod-like link 26 is arranged to extend generally along an axis of the corresponding intake valve 12. As is seen from FIG. 2, one end 26*a* of the rod-like link 26 is pivotally connected to the other end 18*c* of the rocker arm 18 through a connecting pin 28.

When, with the above-mentioned arrangement, the drive shaft 13 is rotated due to rotation of the crankshaft, the ring-like link 25 is forced to make a translation motion through the eccentric cam 15, and thus the swing cam 20 is forced to swing through the rocker arm 18 and the rod-like link 26 resulting in that the intake valves 12 are forced to make open/close movement against force of the valve springs (not shown).

While, when the control shaft 16 is rotated within a given angular range by an after-mentioned actuator 30, the center "P1" of the control cam 17, which serves as a rotation center of the rocker arm 18, is forced to move about the center "P2" of the control shaft 16. With this movement, a link unit including the ring-like link 25, the rocker arm 18 and the rod-like link 26 is forced to change its posture and thus the working angle and valve lift degree of the intake valves 12 are continuously varied keeping the operation phase of the same constant.

In the above-mentioned working angle varying mechanism 1, the swing cam 20 which actuates the intake valve 12 is rotatably disposed about the drive shaft 13 which is rotated along with the crankshaft of the engine. Accordingly, undesired center displacement of the swing cam 20 relative to the drive shaft 13 is suppressed, and thus, controllability is improved. Since the swing cam 20 is supported by the drive shaft 13, there is no need of providing a separate supporting shaft for the swing cam 20. Thus, advantages are expected in view of the number of parts used and the mounting space. Furthermore, since the connecting portions of the parts are made through a so-called surface to surface contact, adequate abrasion resistance is obtained.

Figure 4:
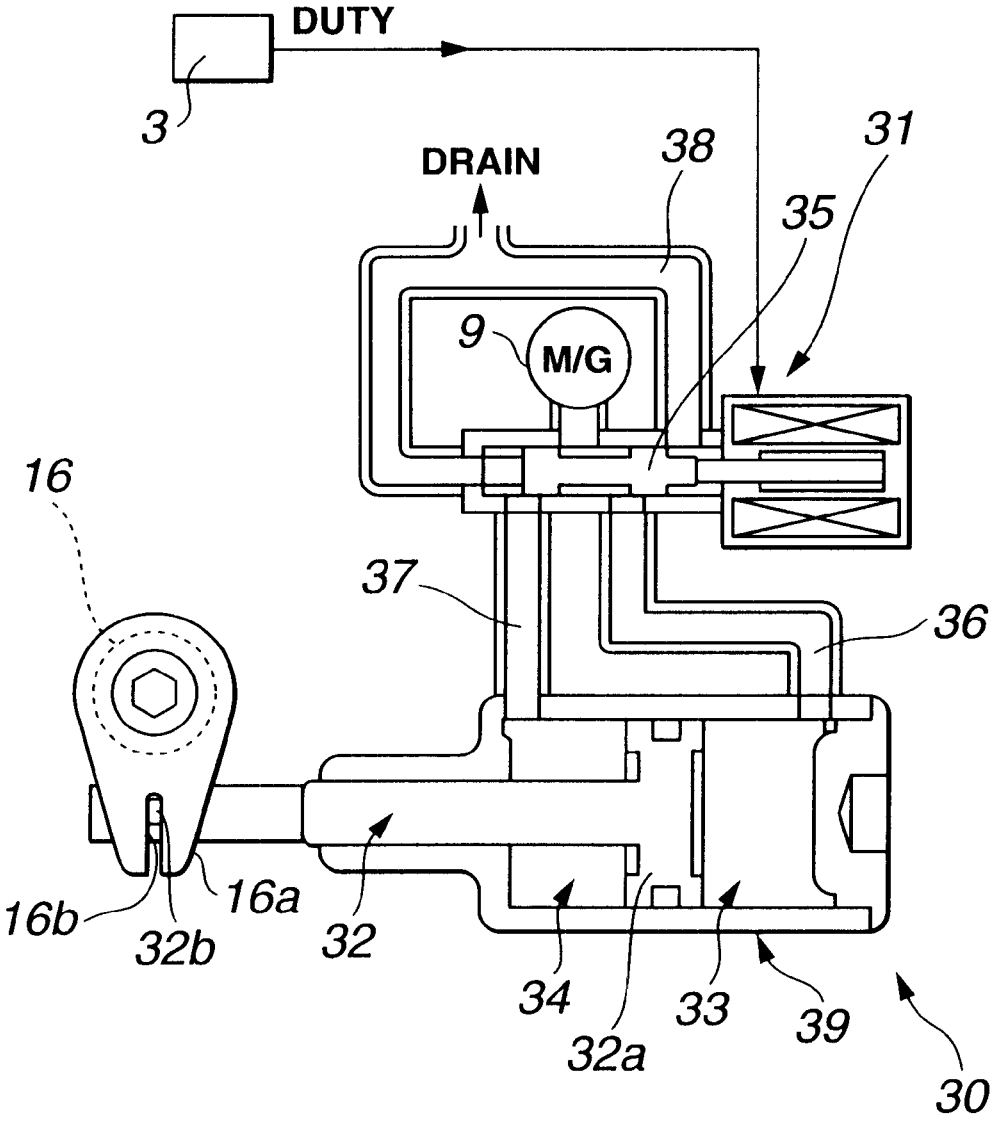
FIG. 4 is a diagram showing a hydraulic actuator and a solenoid valve which are used for controlling a control shaft of the working angle varying mechanism.

Referring to FIG. 4, there is shown the actuator 30 which rotates the control shaft 16 within a predetermined angular range. The actuator 30 comprises a cylinder 39 of which interior is divided into first and second hydraulic chambers 33 and 34 due to provision of a piston proper part 32*a* of a piston 32. Thus, in accordance with a pressure difference appearing between the first and second hydraulic chambers 33 and 34, the piston 32 is forced to move in a fore-and-aft direction. A stem portion of the piston 32 has a leading end exposed to the open air. The leading end of the piston stem has a pin 32*b* fixed thereto. As shown, the piston stem extends perpendicular to an axis of the control shaft 16. A link plate 16*a* is fixed to one end of the control shaft 16 to rotate therewith about the axis of the control shaft 16. The link plate 16*a* is formed with a radially extending slot 16*b* with which the pin 32*b* of the piston stem is slidably engaged. Accordingly, upon the fore-and-aft movement of the piston 32, the control shaft 16 is rotated within a predetermined angular range about its axis.

Oil supply to the first and second hydraulic chambers 33 and 34 is switched in accordance with the position of a spool 35 of a solenoid valve 31. The solenoid valve 31 is controlled in ON/OFF manner (viz., duty-control) by a control signal issued from an engine control unit 3. The control unit 3 comprises a micro-computer including generally CPU, RAM, ROM and input and output interfaces. That is, by varying the duty ratio of the control signal in accordance with the operation condition of the engine, the position of the spool 35 is changed.

That is, when, as shown in the drawing, the spool 35 assumes a rightmost position, a first hydraulic passage 36 connected with the first hydraulic chamber 33 is connected with an oil pump 9 thereby feeding the first hydraulic chamber 33 with a hydraulic pressure and at the same time, a second hydraulic passage 37 connected with the second hydraulic chamber 34 is connected with a drain passage 38 thereby draining the oil from the second hydraulic chamber 34. Accordingly, the piston 32 of the actuator 30 is shifted leftward in the drawing.

While, when the spool 35 assumes a leftmost position in the drawing, the first hydraulic passage 36 is connected with the drain passage 38 to drain the oil from the first hydraulic chamber 33, and at the same time, the second hydraulic passage 37 is connected with the oil pump 9 to feed the second hydraulic chamber 34 with a hydraulic pressure. Thus, the piston 32 is shifted rightward in the drawing.

While, when the spool 35 is in a middle position, both of the first and second hydraulic passages 36 and 37 are closed by the spool 35, and thus, the hydraulic pressure in the first and second hydraulic chambers 33 and 34 is held or locked thereby holding the piston 32 in a corresponding middle position.

As is described hereinabove, the piston 32 of the actuator 30 is moved to or held at a desired position, and thus, the working angle of the intake valves 12 can be controlled to a desired angle within a predetermined angular range.

It is to be noted that the engine control unit 3 controls the working angle varying mechanism 1 and the operation phase varying mechanism 2 in accordance with an engine speed, an engine load, a temperature of engine cooling water and a vehicle speed. In addition to this control, the engine control unit 3 carries out an ignition timing control, a fuel supply control, a transition correction control and a fail-safe control.

In the following, the operation phase varying mechanism 2 will be described with reference to FIGS. 5 to 9 and FIG. 1.

As will become apparent as the description proceeds, the operation phase varying mechanism 2 functions to vary a relative angular position between the drive shaft 13 and a timing pulley 40 that is rotatably disposed on the drive shaft 13 and synchronously rotated together with the engine crankshaft, so that the operation phase of the intake valves 12 is varied while keeping the working angle and the valve lift degree of the intake valves 12 constant.

Figure 5:
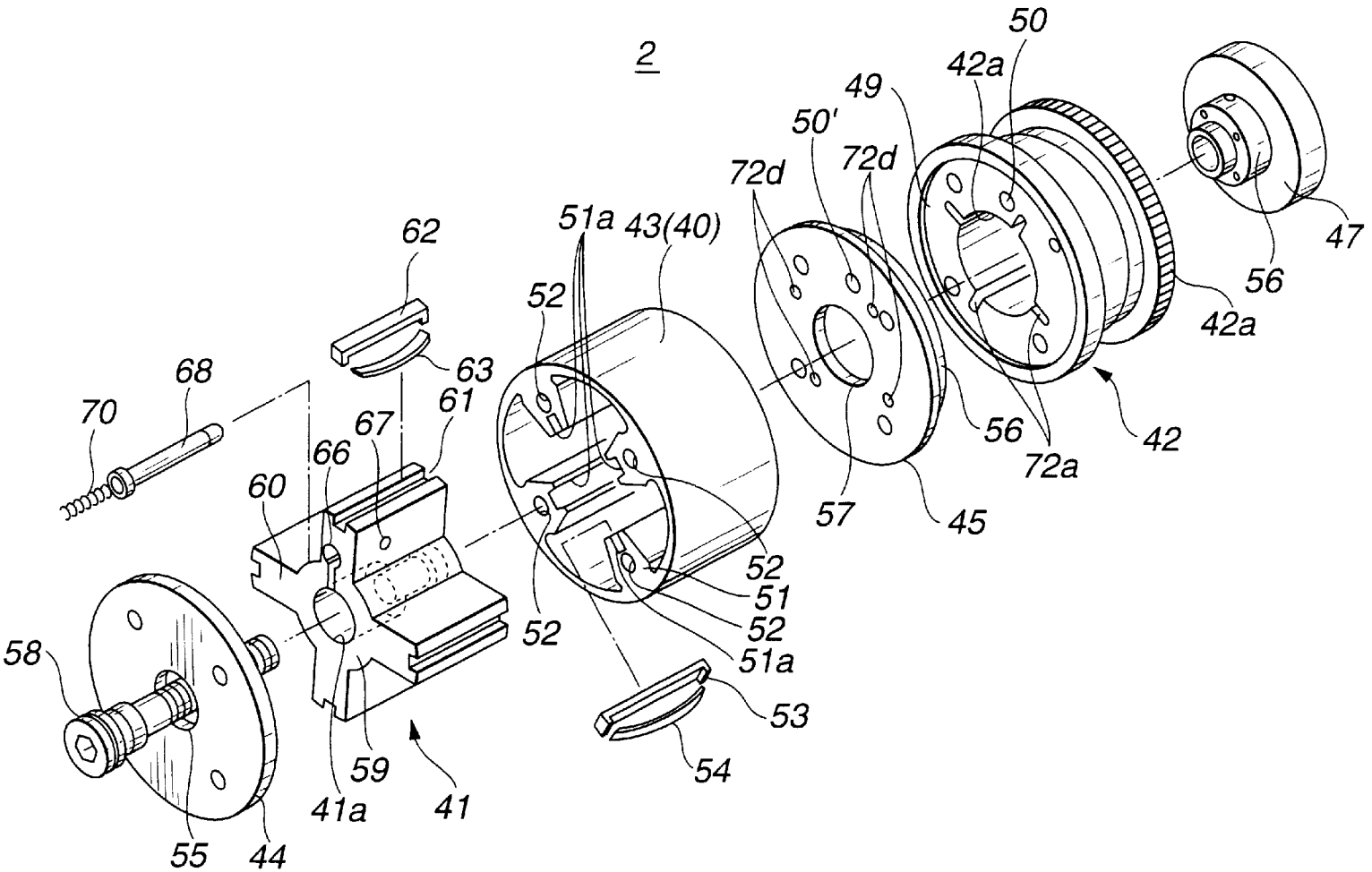
FIG. 5 is an exploded view of an operation phase varying mechanism employed in the intake valve control device of the invention.
Figure 6:
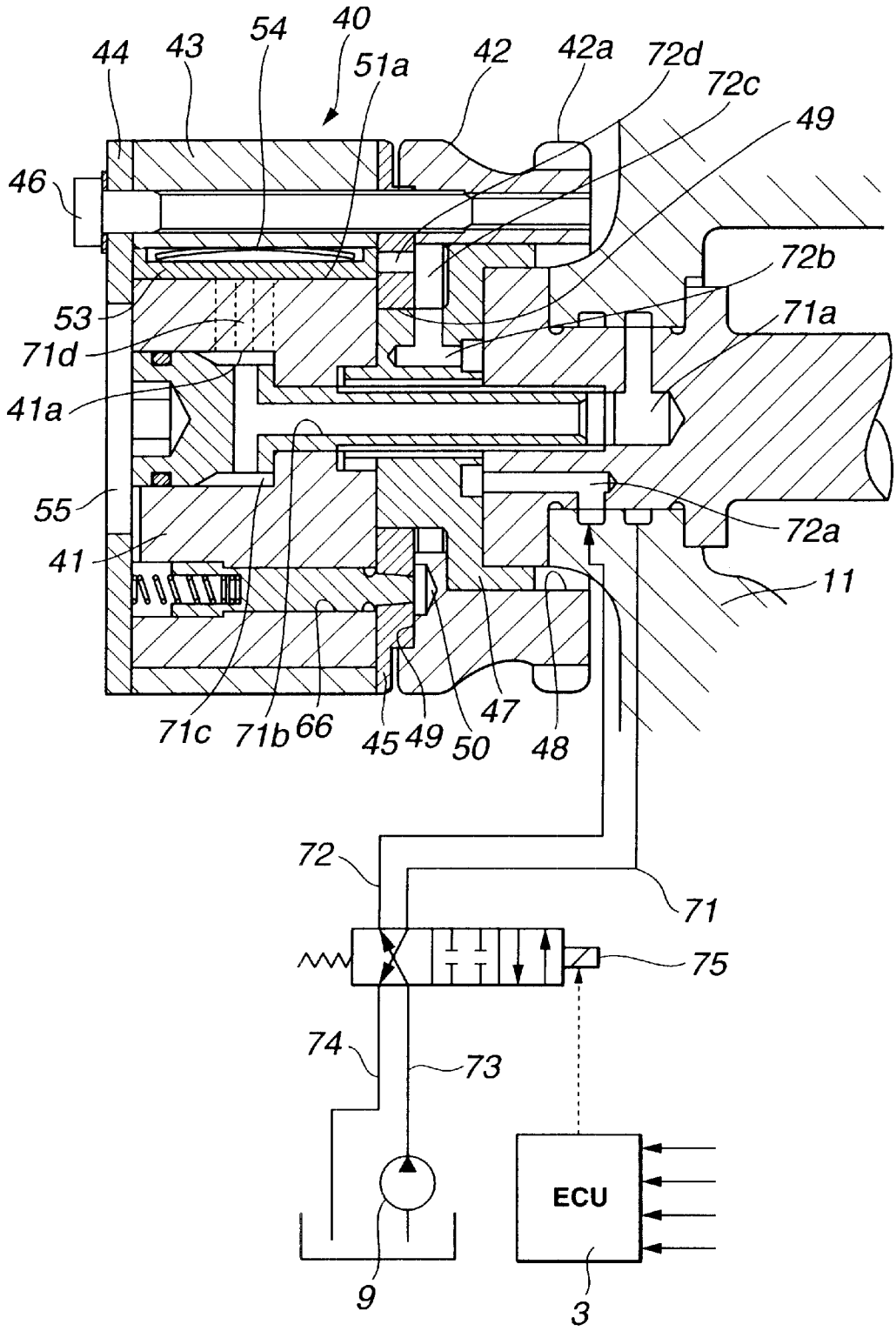
FIG. 6 is a sectional view the operation phase varying mechanism in an assembled condition.

That is, as is seen from FIGS. 1, 5 and 6, the operation phase varying mechanism 2 comprises generally the timing pulley 40 fixed to an axial end of the drive shaft 13, a vane unit 41 rotatably installed in the timing pulley 40 and a hydraulic circuit structure arranged to rotate the vane unit 41 in both directions by a hydraulic power.

As is seen from FIG. 5, the timing pulley 40 generally comprises a rotor member 42 which has an external gear 42*a* meshed with teeth of a timing chain (not shown), a cylindrical housing 43 which is arranged in front of the rotor member 42 and rotatably disposes therein the vane unit 41, a circular front cover 44 which covers a front open end of the housing 43, a circular rear cover 45 which is arranged between the housing 43 and the rotor member 42 and covers a rear open end of the housing 43, and a plurality of bolts 46 (see FIG. 6) which coaxially connects the housing 43, the front cover 44 and the rear cover 45 as a unit.

As is seen from FIGS. 5 and 6, the rotor member 42 is of a cylindrical member and has a center bore 42*a* formed therethrough. The rotor member 42 is formed with a plurality of internally threaded bolt holes (no numerals) with which the threads of the bolts 46 are engaged. Furthermore, as is seen from FIG. 6, the center bore 42*a* of the rotor member 42 has a diametrically enlarged rear (or right) portion 48 which is mated with an after-mentioned sleeve member 47. Furthermore, the rotor member 42 has at its front (or left) side a coaxial circular recess 49 which has the rear cover 45 mated therewith. The rotor member 42 has further an engaging hole 50 at a given portion of the circular recess 49.

As is seen from FIG. 5, the cylindrical housing 43 has axial both ends opened and has on its inner surface four axially extending partition ridges 51 which are arranged at equally spaced intervals (viz., 90°). As shown, each partition ridge 51 has a generally trapezoidal cross section and has axial both ends flush with the both ends of the cylindrical housing 43. Furthermore, each partition ridge 51 has an axially extending bolt hole 52 through which the corresponding bolt 46 passes. Furthermore, each partition ridge 51 has at its inner top portion an axially extending holding groove 51*a*. As may be seen from FIG. 6, each holding groove 51*a* receives therein an elongate seal member 53 and a plate spring 54 which biases the seal member 53 radially inwardly.

As is seen from FIG. 5, the circular front cover 44 is formed with a center opening 55. The front cover 44 further has four bolt holes (no numerals) which are mated with the bolt holes 52 of the cylindrical housing 43.

As is seen from FIG. 5, the circular rear cover 45 is formed on its rear side with an annular ridge 56 which is intimately engaged with the circular recess 49 of the above-mentioned rotor member 42. Furthermore, the rear cover 45 is formed with a center opening 57 with which a smaller diameter annular portion 56 of the sleeve member 47 is engaged. The rear cover 45 has further four bolt holes (no numerals) which are mated with the bolt holes 52 of the cylindrical housing 43. Furthermore, the rear cover 45 is formed with an engaging hole 50' at a position corresponding to the engaging hole 50 of the rotor member 42.

As is seen from FIG. 5, the vane unit 41 is made of a sintered alloy and is connected to the front end of the drive shaft 13 (see FIG. 1) through a connecting bolt 58. That is, the vane unit 41 is rotated together with the drive shaft 13. More specifically, the vane unit 41 comprises a cylindrical base portion 59 which has an axially extending bore 41a through which the connecting bolt 58 passes, and four equally spaced and axially extending vane portions 60 which are raised radially outward from the base portion 59.

Figure 7:
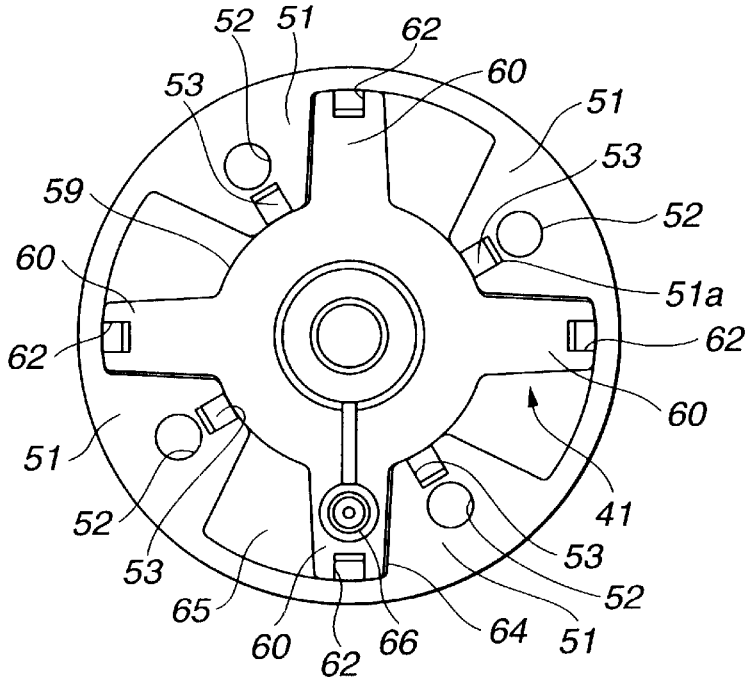
FIG. 7 is a sectional view of an essential portion of the operation phase varying mechanism.

As shown, each vane portion 60 is in the rectangular shape, and as is seen from FIG. 7, each vane portion 60 is put between two adjacent partition ridges 51 of the housing 43. Each vane portion 60 has at its outer top portion an axially extending holding groove 61. Each holding groove 61 receives therein an elongate seal member 62 and a plate spring 63 which biases the seal member 62 radially outwardly. As shown in FIG. 7, each seal member 53 of the cylindrical housing 43 is biased against an outer cylindrical wall of the cylindrical base portion of the vane unit 41 to establish a hermetic sealing therebetween, and each seal, member 62 of the vane unit 41 is biases against an inner cylindrical wall of the cylindrical housing 43 to establish a hermetic sealing therebetween.

As is seen from FIG. 7, due to placement of the vane portion 60 of the vane unit 41 in each space defined between two adjacent partition ridges 51 of the cylindrical housing 43, there are defined an advancing hydraulic chamber 64 and a retarding hydraulic chamber 65 in the space.

As is seen from FIGS. 5 and 7, one of the vane portions 60 of the vane unit 41 is formed with an axially extending bore 66 at a position corresponding to the engaging hole 50' of the rear cover 45. As is seen from FIG. 5, the vane portion 60 is formed with a small passage 67 for connecting the advancing and retarding hydraulic chambers 65 and 66.

As is seen from FIGS. 5 and 6, a lock pin 68 is axially slidably received in the axially extending bore 66 of the vane portion 60. As is seen from FIGS. 8 and 9, the lock pin 68 comprises a cylindrical middle portion 68*a*, a smaller diameter engaging portion 68*b* and a larger diameter stopper portion 68*c*.

Figure 8:
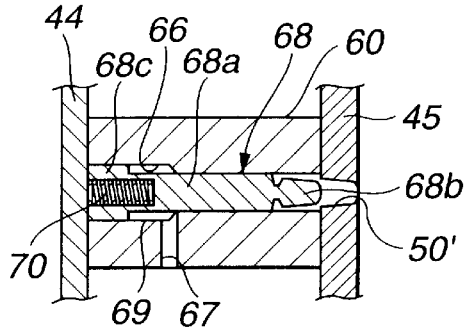
FIG. 8 is a partial view showing an unlocked condition of the operation phase varying mechanism.

As is seen from FIG. 8, for hydraulically actuating the lock pin 68 in the bore 66 of the vane portion 60, there is formed a pressure receiving chamber 69 which is defined by a stepped surface of the larger diameter stopper portion 68*c*, the an outer surface of the middle portion 68*a* and a cylindrical inner wall of the bore 66. Between the lock pin 68 and the front cover 44, there is compressed a coil spring 70 which biases the lock pin 68 toward the rear cover 45.

Figure 9:
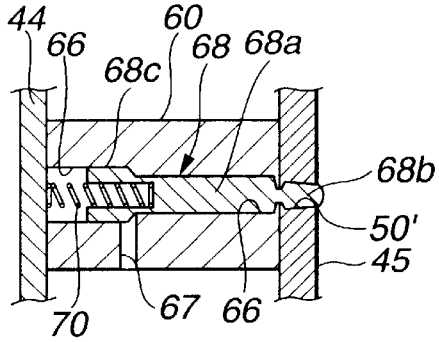
FIG. 9 is a view similar to FIG. 8, but showing a locked condition of the operation phase varying device.

It is to be noted that when the vane unit 41 assumes a most retarded angular position, the engaging portion 68*b* of the lock pin 68 is engaged with the engaging hole 50' of the rear cover 45 as is seen from FIG. 9.

As is seen from FIG. 6, the hydraulic circuit structure comprises a first hydraulic passage 71 through which hydraulic pressure is fed to or discharged from the advancing hydraulic chamber 64 and a second hydraulic passage 72 through which hydraulic pressure is fed to or discharged from the retarding hydraulic chamber 65. These first and second hydraulic passages 71 and 72 are connected to supply and drain passages 73 and 74 through an electromagnetic switch valve 75.

As is seen from FIG. 6, the first hydraulic passage 71 comprises a first passage part 71*a* which is formed in both the cylinder head 11 and the drive shaft 13, a first oil passage 71*b* which is formed in the connecting bolt 58 and connected to the first passage part 71*a*, an oil chamber 71*c* which is defined between an outer cylindrical surface of an enlarged head of the connecting bolt 58 and an inner cylindrical surface of the axially extending bore 41*a* of the base portion 59 of the vane unit 41 and connected to the first oil passage 71*b* and four radially extending branched passages 71d which are formed in the base portion 59 of the vane unit 41 to connect the oil chamber 71*c* with the four advancing hydraulic chambers 64.

While, as is seen from FIG. 6, the second hydraulic passage 72 comprises a second passage part 72*a* which is formed in both the cylinder head 11 and the drive shaft 13, a second oil passage 72*b* which is formed in the sleeve member 57 and connected to the second passage part 72*a*, four oil grooves 72c formed at an inner surface of the center bore 42*a* of the rotor member 42 and connected to the second oil passage 72*b* and four oil holes 72*d* which are formed in the rear cover 45 at equally spaced intervals to connect the four oil grooves 72*c* with the four retarding hydraulic chambers 65 respectively.

The electromagnetic switch valve 75 is of a type having four ports and three operation positions. That is, due to movement of a spool installed in the valve 75, the first and second hydraulic passages 71 and 72 are selectively connected to and blocked from the supply and drain passages 73 and 74. The movement of the spool is controlled (duty-control) by a control signal issued from the engine control unit 3.

By processing information signals from a crank angle sensor and an air flow meter, the control unit 3 detects an existing operation condition of the engine. Furthermore, by processing information signals from a crank angle sensor and a cam angle sensor, the control units 3 detects a relative angular position between the timing pulley 40 and the drive shaft 13.

In an initial condition induced when the engine stops, the spool of the valve 75 assumes its rightmost position as shown in FIG. 6. In this condition, the supply passage 73 is connected with the second hydraulic passage 72 and at the same time, the drain passage 74 is connected with the first hydraulic passage 71. Accordingly, hydraulic pressure in the four retarding hydraulic chambers 65 is kept unchanged, while hydraulic pressure in the four advancing hydraulic chambers 64 is reduced to zero due to connection with the drain passage 74. Under this condition, as is seen from FIG. 7, the vane unit 41 assumes a leftmost position or most retarded position wherein each vane portion 60 abuts against a right face of the corresponding left partition ridge 51 of the cylindrical housing 43. In this condition, the operation phase of each intake valve 12 is controlled at a retarded side.

In an initial stage of engine starting, the vane unit 41 is held in the most retarded position. When, under this initial stage, the hydraulic pressure in the retarding hydraulic chambers 65 is relatively low in such a degree that the hydraulic pressure fed to the pressure receiving chamber 69 through the bore 67 is still lower than the force of the coil spring 70, the lock pin 68 is kept engaged with the engaging hole 50' of the rear cover 45, as is shown in FIG. 9. Accordingly, the vane unit 41 is locked to the cylindrical housing 43 keeping the most retarded angular position. Thus, undesired vibration, which would be caused by a varying hydraulic pressure in the retarding hydraulic chambers 64 and a varying torque produced by the drive shaft 13, is suppressed or at least minimized. This prevents generation of noises caused by collision of the vane portions 60 against the partition ridges 51.

When, after passing of a certain time from the engine starting, the hydraulic pressure in the retarding hydraulic chamber 65 is increased and at the same time the hydraulic pressure in the pressure receiving chamber 69 is increased. Thus, the lock pin 68 is moved back against the force of the coil spring 70 and thus finally, as is seen from FIG. 8, the lock pin 68 is disengaged from the engaging hole 50' of the rear cover 45. Upon this, the locked condition between the vane unit 41 and the cylindrical housing 43 becomes canceled permitting free rotation of the vane unit 41 in the housing 43.

When the spool (see FIG. 6) of the switch valve 75 is moved to its leftmost position in the drawing, the supply passage 73 becomes connected with the first hydraulic passage 71 and at the same time the drain passage 74 becomes connected with the second hydraulic passage 72. Accordingly, in this condition, hydraulic pressure in the retarding hydraulic chamber 65 is led to the oil pan through the second hydraulic passage 72 and the drain passage 74, and at the same time, hydraulic pressure from the oil pump 9 is led into the advancing hydraulic chamber 64 through the supply passage 73 and the first hydraulic passage 71. Upon this, the vane unit 41 is turned in a clockwise direction in FIG. 7, that is, in an advancing direction, and thus, the operation phase of each intake valve 12 is shifted to an advanced side.

While, when the spool (see FIG. 6) of the switch valve 75 is kept in a middle position, both the first and second hydraulic passages 71 and 72 are blocked by the spool. As a result, hydraulic pressure in both the first and second hydraulic chambers 33 and 34 of the actuator 30 are locked, so that the vane unit 41 assumes a corresponding intermediate position, keeping the operation phase of each intake valve 12 at a corresponding value.

As is described hereinabove, in the operation phase varying mechanism 2, by changing the position of the spool of the electromagnetic switch valve 75 in accordance with the operation condition of the engine, the vane unit 41 can be held in a desired intermediate position. That is, according to the operation phase varying mechanism 2, the operation phase of each intake valve 12 can be varied and held in a desired value irrespective of the simple structure possessed by the mechanism 2.

As is easily seen from FIG. 1, in the intake valve control device of the invention, the working angle varying mechanism 1 and the operation phase varying mechanism 2 are arranged at different positions without making a relative interference therebetween. Both the mechanisms 1 and 2 are powered by a common oil pump 9, which is one of conditions to simplify the construction of the intake valve control device.

Figures 10A, 10B, 10C:
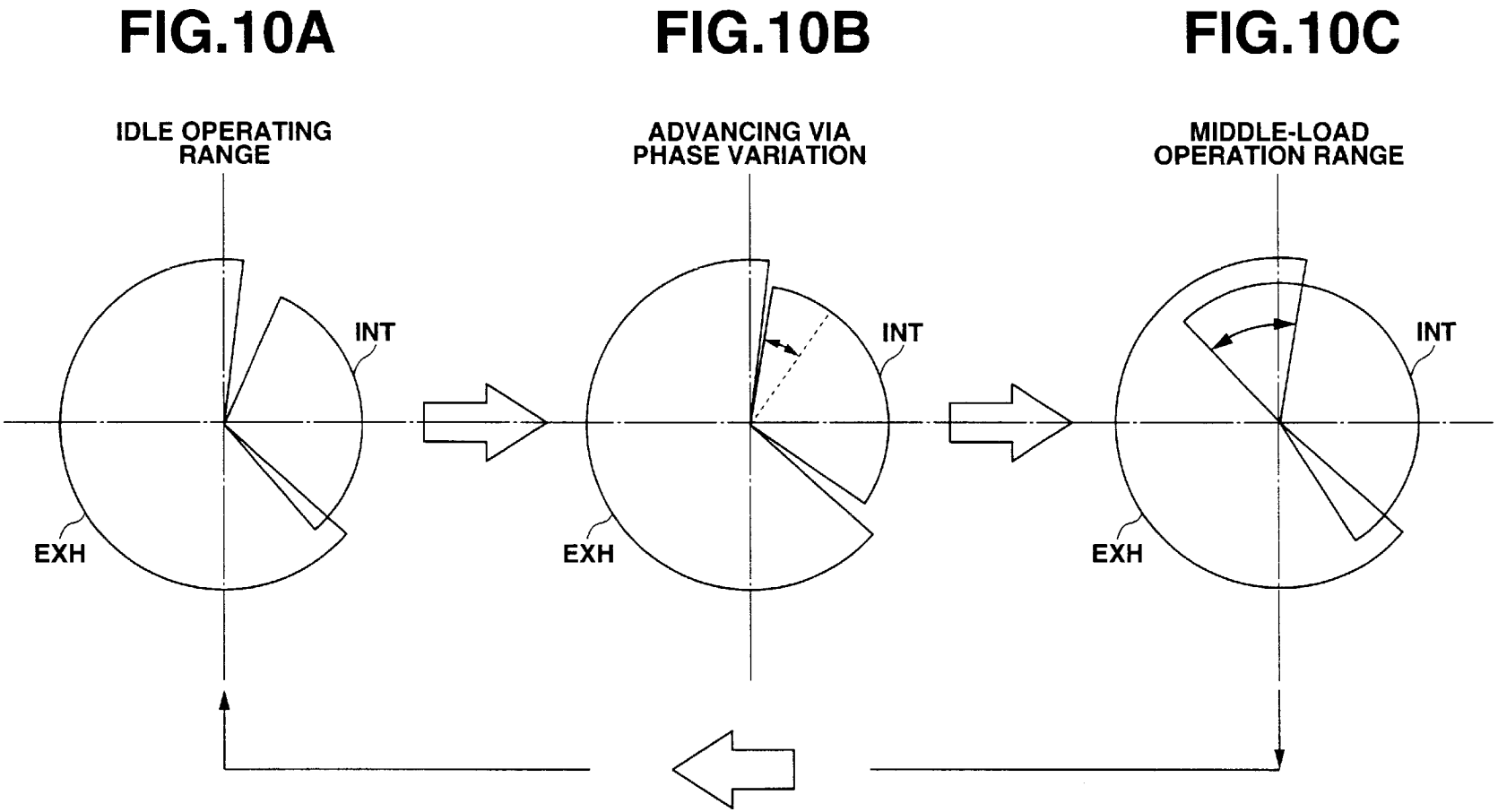
FIGS. 10A, 10B and 10C are illustrations showing various conditions of the intake valve control device of the present invention.

FIGS. 10A, 10B and 10C are illustrations schematically showing open/close timings of the intake valve induced by the intake valve control device of the invention during the time when the engine is being shifted from an idle operation range to a middle-load operation range. In the illustrations, the open timing of the exhaust valve is shown set near the top dead center (TDC).

As is seen from FIG. 10A, in the idle operation range wherein the load of the engine is quite small, the open timing of the intake valve 12 takes place after the top dead center (TDC) and the close timing of the same takes place before the bottom dead center (BDC). In this idle operation range, due to work of the working angle varying mechanism 1, the working angle of the intake valve 12 is controlled to or near the minimum value.

That is, in order to obtain a stable combustion in such quite low load operation range of the engine, the valve overlap is reduced (viz., minus valve overlap) to reduce the residual gas in the cylinders. By setting the open timing of the intake valve 12 after the top dead center (TDC), the pressure difference between the intake port and the cylinder just before opening of the intake valve is increased and the valve lift degree (or working angle) is reduced. With this, the practical air intake passage becomes narrow, so that the velocity of air into the cylinders is sufficiently increased thereby promoting fuel atomization and thus stabilizing the fuel combustion in the cylinders. Due to the reduction in valve lift degree, valve friction is reduced.

When the engine is shifted from the above-mentioned quite low load operation range toward a higher-load operation range as is seen from FIG. 10A to FIG. 10B, the following steps take place.

That is, as is seen from FIG. 10B, mainly the open timing of the intake valve is shifted or advanced, by the work of the operation phase varying mechanism 2, to or near the close timing of the exhaust valve or to a point where valve overlap appears. That is, due to the work of the mechanism 2, the operation phase of the intake valve is advanced. With this, the open timing of the intake valve is advanced toward the top dead center (TDC) thereby to reduce undesired pumping loss. Furthermore, as is seen from FIG. 10B, the close timing of the intake valve is advanced going away from the bottom dead center (BDC), thereby to suitably control the air intake amount.

When the engine load is further increased to a middle-load operation range as is seen from FIG. 10B to FIG. 10C, that is, when the valve overlap becomes marked, the action for increasing the working angle of the intake valve is mainly carried out by the working angle varying mechanism 1. With this, as is seen from FIG. 10C, the open timing of the intake valve is advanced increasing the valve overlap and increasing the residual gas (viz., internal EGR gas). In addition to the advancement in the open timing, the close timing of the intake valve is retarded as shown in FIG. 10C. That is, the amount of fresh air which would be reduced due to increase of the valve overlap can be compensated by the retardation in the close timing of the intake valve. That is, by only the working angle varying mechanism 1, both the amount of fresh air and that of residual gas are effectively controlled, which brings about improvement in fuel consumption of the engine.

While, in case where the engine is rapidly shifted from the middle-load operation range to the idle operation range as is seen from FIG. 10C to FIG. 10A, it is necessary to quickly reduce the valve overlap degree for suppressing deterioration of the combustion stability of the engine. For reducing the valve overlap, it is necessary to retard the open timing of the intake valve 12.

For retarding the open timing of the intake valve 12, there are two methods, one being a method that is carried out by the operating angle varying mechanism 1, and the other being a method that is carried out by the operation phase varying mechanism 2. In case of the mechanism 1, the working angle of the intake valve 12 is reduced, and in case of the other mechanism 2, the operation phase of the intake valve 12 is retarded.

In case of varying the operation phase of the intake valve by operating the operation phase varying mechanism 2, the advancement of the operation phase needs a certain energy to overcome an averaged friction of the drive shaft 13, while the retardation of the operation phase is carried out with the assist of the averaged friction. Accordingly, under the even energy, that is, under the hydraulic pressure produced by the oil pump 9, the phase retardation achieving speed at which the retardation of operation phase is completed is higher than the phase advancement achieving speed at which the advancement of the same is completed. However in case wherein the working angle (or valve lift degree) is relatively small, the averaged friction of the drive shaft 13 is small and thus the assist by the averaged friction is small, which lowers the phase retardation achieving speed.

While, in case of varying the working angle of the intake valve by operating the working angle varying mechanism 1, the increase of the working angle needs a certain energy to overcome the biasing force of the valve spring of the intake valve, while the reduction of the working angle is carried out with the assist of the biasing force of the valve spring. Accordingly, the working angle reduction achieving speed at which the reduction of working angle is completed is higher than the working angle increase achieving speed at which the increase of working angle is completed. Due to inevitable construction of the working angle varying mechanism 1, the working angle reduction achieving speed is much higher than the above-mentioned phase retardation achieving speed by the operation phase varying mechanism 2 by about three or four times.

As will be understood from the foregoing description, in the intake valve control device having the working angle varying mechanism 1 and operation phase varying mechanism 2 which are arranged in the above-mentioned manner, the phase retardation achieving speed of the open timing of the intake valve 12 which is effected by the working angle varying mechanism 1 is much higher than that which is effected by the operation phase varying mechanism 2.

Accordingly, in the present invention, in case wherein the engine is shifted from the middle-load operation range to the idle operation range, that is, in case wherein reduction of the valve overlap is needed, the retardation of the open timing of the intake valve 12 is carried out mainly by the working angle varying mechanism 1, that is, by reducing the working angle of the intake valve 12. With this operation, the valve overlap is quickly reduced. This means that the valve overlap at the middle-load operation range (FIG. 10C) can be set to a satisfactorily larger degree. As is mentioned hereinabove, increased valve overlap brings about increase of internal EGR gas and improvement in fuel consumption.

Furthermore, in the invention, the variation of the open timing (and close timing) of the intake valve 12 effected by the working angle varying mechanism 1 is set greater than that effected by the operation phase varying mechanism 2. More specifically, the variation of the open timing (and close timing) of the intake valve 12 during the time when the control shaft 16 of the working angle varying mechanism 1 is rotated from the largest working angle position to the smallest working angle position is set sufficiently greater than that during the time when the vane unit 41 of the operation phase varying mechanism 2 is rotated from the most advanced position to the most retarded position.

With this setting, the valve overlap at the middle-load operation range can be much increased, which brings about much increase of internal EGR gas and much improvement in fuel consumption.

When the operation phase of the intake valve 12 is left displaced from a target phase upon requirement of rapid range change of the engine from the middle-load operation range to the idle operation range, the working angle varying mechanism 1 is firstly operated to shift the operation phase to the target phase, while resting the operation phase varying mechanism 2. That is, by intensively using the hydraulic pressure for driving the working angle varying mechanism 1, reduction of valve overlap can be quickly carried out.

Usually, hydraulic pressure fed to both the working angle and operation phase varying mechanisms 1 and 2 from the oil pump 9 depends on the engine speed. Thus, when the engine runs at a very low rotation speed, the hydraulic pressure is very low. When, under this low hydraulic pressure, lowering of the valve lift degree is carried out by the operation phase varying mechanism 2, the responsiveness in phase change is greatly lowered. However, as is mentioned hereinabove, when reduction of the working angle is carried out by the working angle varying mechanism 1, the responsiveness shows a satisfaction due to the assist of the biasing force of the valve spring of the intake valve irrespective of the lower hydraulic pressure.

The entire contents of Japanese Patent Application 2000-262110 (filed Aug. 31, 2000) are incorporated herein by reference.

Although the invention has been described above with reference to the embodiment of the invention, the invention is not limited to such embodiment as described above. Various modifications and variations of such embodiment may be carried out by those skilled in the art, in light of the above descriptions.

What is claimed is:

1. In an internal combustion engine having intake and exhaust valves, a first mechanism which varies a working angle of the intake valve and a second mechanism which varies an operation phase of the intake valve, a method of controlling operation of said engine, comprising:

controlling variation in the open timing of the intake valve effected by said first mechanism to be larger than variation in the open timing of the intake valve effected by said second mechanism.

2. An intake valve control device of an internal combustion engine having intake and exhaust valves, comprising:

a first mechanism which varies a working angle of the intake valve;

a second mechanism which varies an operation phase of the intake valve; and a control unit which controls both said first and second mechanisms in accordance with an operation condition of the engine, said control unit being configured to carry out controlling variation in the open timing of the intake valve effected by said first mechanism to be larger than variation in the open timing of the intake valve effected by said second mechanism.

3. An intake valve control device as claimed in claim 2, in which said control unit is configured to carry out:

when the engine is under a condition wherein reduction of a valve overlap between the intake and exhaust valves is needed, operating said first mechanism mainly to reduce the working angle of said intake valve.

4. An intake valve control device as claimed in claim 2, in which said first and second mechanisms are powered by hydraulic pressure produced when the engine operates.

5. An intake valve control device as claimed in claim 2, in which said control unit is configured to carry out:

when the engine is shifted from a middle-load operation range to a very low load operation range, operating said first mechanism to reduce the working angle of the intake valve prior to operating said second mechanism to vary the operation phase of the intake valve.

6. An intake valve control device as claimed in claim 2, in which said first mechanism is operatively arranged between a drive shaft which is synchronously rotated together with an engine crankshaft and a swing cam which is pivotally disposed around said drive shaft, said swing cam opening and closing said intake valve when swung.

7. An intake valve control device as claimed in claim 6, in which said first mechanism comprises:

an eccentric cam eccentrically fixed to said drive shaft to rotate therewith;

a first link rotatably disposed on said eccentric cam;

a control shaft extending in parallel with said drive shaft;

a control cam eccentrically fixed to said control shaft to rotate therewith;

a rocker arm rotatably disposed on said control cam and having one end pivotally connected to one end of said first link; and a second link having one end pivotally connected to the other end of said rocker arm and the other end pivotally connected to said swing arm.

8. An intake valve control device as claimed in claim 6, in which said second mechanism is arranged between said drive shaft and a rotating body synchronously rotated together with the engine crankshaft in a manner to vary a relative angular position between said drive shaft and said rotating body.

9. An intake valve control device as claimed in claim 8, in which said second mechanism comprises:

a cylindrical hollow member having front and rear covers hermetically secured to front and rear ends of the hollow member, said cylindrical hollow member being adapted to be rotated by the engine crankshaft;

a plurality of partition ridges formed on an inner cylindrical surface of said cylindrical hollow member at equally spaced intervals, so that identical spaces are each defined between adjacent two of said partition ridges;

a vane unit having a plurality of vane portions arranged at equally spaced intervals, said vane unit being rotatably disposed in said cylindrical hollow member so that each vane portion partitions the corresponding identical space into first and second hydraulic chambers, said vane unit being coaxially connected to said drive shaft to rotate therewith;

a first hydraulic passage fluidly connectable to said first hydraulic chamber; and a second hydraulic passage fluidly connectable to said second hydraulic chamber.

10. An intake valve control device as claimed in claim 9, in which said second mechanism further comprising a lock device which establishes a locked condition between said vane unit and said cylindrical hollow member when said vane unit assumes a given angular position relative to said cylindrical hollow member.

11. An intake valve control device as claimed in claim 10, in which said lock device comprises:

an axially extending bore formed in one of said vane portions of said vane unit, said bore being formed with an enlarged part at one end thereof;

a lock pin slidably disposed in said axially extending bore;

a spring disposed in the enlarged part of said bore to bias said lock pin toward said rear cover; and an engaging hole formed in said rear cover to receive a leading end of lock pin when said vane unit assumes the given angular position relative to said cylindrical member.

12. An intake valve control device as claimed in claim 11, in which said second mechanism further comprising:

a connecting bolt through which said vane unit is tightly and coaxially connected to said drive shaft;

first sealing members disposed on said partition ridges of said cylindrical hollow member to establish a sealed and sliding contact between each partition ridge and a cylindrical base portion of said vane unit; and second sealing members disposed on tops of said vane portions of said vane unit to establish a sealed and sliding contact between each vane portion and the cylindrical inner wall of said cylindrical hollow member.

13. An intake valve control device as claimed in claim 12, in which one of said vane portions of said vane unit is formed with a passage through which adjacent first and second hydraulic chambers are fluidly connected.

14. An intake valve control device as claimed in claim 9, in which said cylindrical hollow member of said second mechanism is provided with an internal gear which is adapted to be meshed with teeth of a timing chain of the engine.

* * * * *